US006794046B1

(12) United States Patent
Kurze et al.

(10) Patent No.: US 6,794,046 B1
(45) Date of Patent: Sep. 21, 2004

(54) CHEMICALLY PASSIVATED OBJECT MADE OF MAGNESIUM OR ALLOYS THEREOF

(75) Inventors: Peter Kurze, Nideggen (DE); Ulrike Kruger, Kerpen (DE); Marco Kohler, Bornheim (DE); Dora Bānerjee, Kerpen (DE)

(73) Assignee: AHC Oberflachenechnik GmbH & Co. OHG (DE)

( * ) Notice: Subject to any disclaimer, the term of this patent is extended or adjusted under 35 U.S.C. 154(b) by 0 days.

(21) Appl. No.: 09/937,154

(22) PCT Filed: Mar. 22, 2000

(86) PCT No.: PCT/DE00/00872

§ 371 (c)(1),
(2), (4) Date: Sep. 21, 2001

(87) PCT Pub. No.: WO00/56950

PCT Pub. Date: Sep. 28, 2000

(30) Foreign Application Priority Data

Mar. 24, 1999 (DE) ..... 199 13 242

(51) Int. Cl.[7] ..... B32B 15/04

(52) U.S. Cl. ..... 428/469; 148/243; 148/244; 148/272; 148/273; 148/275; 427/419.2; 427/419.3; 428/471

(58) Field of Search ..... 148/243, 244, 148/272, 273, 275; 427/419.2, 419.3; 428/469, 471

(56) References Cited

U.S. PATENT DOCUMENTS 1,723,067 A * 8/1929 Pacz ..... 148/264
3,620,939 A * 11/1971 Fruchtnicht ..... 205/210
5,814,703 A * 9/1998 Yamaya et al. ..... 525/103

FOREIGN PATENT DOCUMENTS

JP 08035073 A * 2/1996 ..... C23C/22/68

* cited by examiner

*Primary Examiner*—Andrew L. Oltmans
(74) *Attorney, Agent, or Firm*—Connolly Bove Lodge & Hutz LLP

(57) ABSTRACT

An article made of magnesium or its alloys, some or all of whose surface has a conversion coating, the conversion coating comprising MgO, $Mn_2O_3$ and $MnO_2$ plus at least one oxide from the group consisting of vanadium, molybdenum and tungsten; and also a process for producing such an article, and its use.

19 Claims, No Drawings

CHEMICALLY PASSIVATED OBJECT MADE OF MAGNESIUM OR ALLOYS THEREOF

The present invention relates to an article made of magnesium or its alloys which has a conversion coating produced by passivating the surface, to a process for producing such an article, and to its use.

Magnesium and its alloys are the lightest but also least noble metallic construction materials (standard potential of Mg −2.34 volts) and therefore have a very strong tendency to corrode. To counter this disadvantageous property, magnesium and its alloys are treated in aqueous passivating electrolytes. The redox procedure which occurs during this treatment (without an external current source) forms a conversion coating consisting of oxides of the magnesium material and oxide-type reaction products originating from the constituents of the aqueous passivating electrolyte.

The term "conversion coating" refers here and below to a coating which is formed not by application to a surface but rather by chemical transformation (conversion) of the metallic surface and of various constituents of the aqueous passivating electrolyte (cf. H. Simon, M. Thoma "Angewandte Oberflächentechnik für metallische Werkstoffe", Carl Hanser Verlag, Munich (1985) p. 4).

For example, the chromation of articles made of magnesium or its alloys is known. The corresponding processes are described in particular in the MIL M3171 type I to type III. In that case, chromic acid or its salts are used for passivation. The use of sodium dichromate in combination with potassium permanganate has also been described (Dow Chemical Treatment, No. 22). Chemical passivation using aqueous passivating electrolytes containing chromium(VI) is simple to carry out. However, it has the serious disadvantage that the chromate substances, which are also present in the resulting conversion coatings, are carcinogenic.

Furthermore, the recyclability of chromated articles made of magnesium or its alloys represents a considerable problem, since because of their heavy metal content such articles require considerable effort in order to be recyclable to what are known as "high-purity" materials.

On grounds of environmental protection and workplace safety, a concern among manufacturers and processors of passivated articles made of magnesium or its alloys is to find a substitute for the conventional chromation, using chromate-free, aqueous passivating electrolytes.

Known chromate-free aqueous passivating electrolytes for the passivation of articles made from magnesium or its alloys are stannate-based aqueous passivating electrolytes which are marketed, for example, by the company Dow Chemical. However, it has been found that the corrosion protection effect of the resulting conversion coating is lower in comparison to the chromated magnesium materials.

U.S. Pat. No. 5,743,971 describes a process for forming corrosion protection coatings on metals such as Zn, Ni, Ag, Fe, Cd, Al, Mg and their alloys.

In this process, these metals are immersed in a solution which comprises an oxidizing agent, a silicate and at least one cation from the group consisting of Ti, Zr, Ce, Sr, V, W and Mo. The pH of this solution is, in particular, in a range between 1.5 and 3.0.

The oxidizing agent is exclusively selected from the group of the peroxo compounds. A potassium permanganate oxidizing agent is not mentioned. Nor does this citation reveal the actual improvements provided by the process it describes for magnesium or its alloys in comparison to conventional chromations.

Moreover, the phosphation of articles made of magnesium or its alloys is also known (cf. Dow Chemical Treatment No. 18). Phosphating with simultaneous use of potassium permanganate is described in D. Hawk, D. L. Albright, "A Phosphate Permanganate Conversion Coating for Magnesium", Metal Finishing, October 1995, pp. 34–38. Here again, the corrosion protection obtained using these aqueous passivating electrolytes is significantly lower in comparison to a chromated coating.

A further possibility for chemical passivation is described by CHIBA Institute of Technology, Japan (published in the conference material INTERFINISHING 96 World Congress, Birmingham, UK, 10–12 Sep. 1996, pp. 425–432), according to which a solution of potassium permanganate, alone or in combination with small amounts of acids ($HNO_3$, $H_2SO_4$, HF), is present in an aqueous passivating electrolyte. The aqueous passivating electrolyte temperature required for the chemical passivation is between 40 and 84° C.

The conversion coating obtainable in this way exhibits a good protective effect; however, the stability of the aqueous passivating electrolyte is inadequate for an industrial application of this process. Thus, after a short time, magnesium dioxide ($MnO_2$) is precipitated, rendering the aqueous passivating electrolyte unusable for the further passification of magnesium materials.

An object of the invention is to provide a chemically passivated article made of magnesium or its alloys whose conversion coating is obtainable by an electrolytic, current-free process which is simple to apply and is transferable to the industrial scale. The corrosion protection effect of such a conversion coating, moreover, should not be poorer than that of the known, chromated articles made of magnesium or its alloys.

This object is achieved in accordance with the invention by means of an article made of magnesium or its alloys, some or all of whose surface has a conversion coating, characterized in that the conversion coating comprises MgO, $Mn_2O_3$ and $MnO_2$ plus at least one oxide from the group consisting of vanadium, molybdenum and tungsten.

The conversion coating of the invention may be obtainable by passivating the article using an aqueous passivating electrolyte which comprises potassium permanganate and at least one alkali metal salt or ammonium salt of an anion from the group consisting of vanadate, molybdate and tungstate.

The object on which the invention is based is likewise achieved by means of a process for producing a conversion coating on an article made of magnesium or its alloys, characterized in that the article is subjected to passivation using an aqueous passivating electrolyte which comprises potassium permanganate and at least one alkali metal salt or ammonium salt of an anion from the group consisting of vanadate, molybdate and tungstate.

The conversion coating of the invention has a golden brown to greyish brown, iridescent colour and comprises MgO, $Mn_2O_3$, $MnO_2$ and at least one oxide from the group consisting of vanadium, molybdenum and tungsten.

Investigations have shown that the corrosion protection effect of this conversion coating is no lower than that of a conventional chromate coating.

Especially in view of the fact that, in comparison with the chromate ions, the anions used in accordance with the invention have when considered individually a lower oxidizing power than chromate ions, it is clear that only through combination of the permanganate ions with the corresponding vanadate, molybdate and/or tungstate ions is a synergistic effect achieved which leads to the formation of a corrosion-inhibiting conversion coating on articles made of magnesium or its alloys.

This is of particular significance since the prior art aqueous passivating electrolytes comprising potassium permanganate can only achieve such an oxidizing power of the electrolyte solution by a reduction in pH and/or increase in temperature.

One possible explanation for this synergistic effect may lie in the formation of very strong, so-called heteropolyacids in the form of their soluble ammonium or alkali metal salts.

A particular advantage of the process of the invention is the fact that, even after a relatively long time in use, the aqueous passivating electrolyte remains stable without the precipitation of magnesium dioxide in an amount which would render the aqueous passivating electrolyte unusable for the passivation of articles made of magnesium or its alloys.

Accordingly, it is possible with the present process in a simple manner simply to top up the chemicals which have been consumed following a prolonged time in use without the need to change the aqueous passivating electrolyte itself.

In accordance with one preferred embodiment of the present invention, a polymer coating obtainable by polymerizing and/or crosslinking a solution comprising at least one alkoxysilane compound is additionally applied to the conversion coating.

In this way, the mechanical and chemical properties of the conversion coating (e.g. corrosion resistance or operation resistance) are greatly increased. In this case, the conversion coating of the invention acts as an adhesion primer.

Accordingly, the conversion coating obtainable in accordance with the process of the invention has pores with a size of between 200 and 1000 nm.

The choice of an alkoxysilane compound as the compound to be polymerized and/or crosslinked ensures that the polymer coating present on the conversion coating is connected firstly as a result of chemisorption via Si-O bonds to the surface of the conversion coat and secondly by chemisorption inside the pores. The penetration of the alkoxysilane compound into the pores of the conversion coating brings about an increase in the contact area and thus in the chemisorption between conversion coating and polymer coating.

The polymer coating is formed by conventional polymerization processes familiar to the person skilled in the art (e.g. air drying, heating or UV radiation).

The amount of alkoxysilane compound in the solution to be applied may vary within wide limits. In general, the solution contains from 5 to 45% by weight, in particular from 10 to 30% by weight, of the alkoxysilane compound. Depending on the required viscosity, the solution may additionally comprise a polar solvent, which is to be chosen such that it does not react with the alkoxysilane compound (e.g. ethanol).

In accordance with one preferred embodiment, the alkoxysilane compound is of the general formula $$R^1_aR^2_bSiX_{(4-a-b)}$$

in which

X is an alkoxy, aryloxy or acyloxy group of 1 to 12 carbon atoms, preferably of 1 to 4 carbon atoms, and in particular is selected from the group consisting of methoxy, ethoxy, n-propoxy, i-propoxy, butoxy, phenoxy, acetoxy and propionyloxy groups;

$R^1$ and $R^2$, which are identical to or different from one another, are selected from the group consisting of amino, monoalkylamino or dialkylamino radicals;

alkyl radicals, especially the alkyl radicals of 1 to 6 carbon atoms, preferably the methyl, ethyl, n-propyl, isopropyl, n-butyl, s-butyl, t-butyl, pentyl, hexyl or cyclohexyl radicals;

alkenyl radicals, especially the alkenyl radicals of 2 to 6 carbon atoms, preferably the vinyl, 1-propenyl, 2-propenyl or butenyl radicals;

alkynyl radicals, especially the alkynyl radicals of 2 to 6 carbon atoms, preferably the acetylenyl or propargyl radicals;

aryl radicals, especially the aryl radicals of 6 to 10 carbon atoms, preferably phenyl or naphthyl radicals;

epoxy radicals, especially the epoxy radicals of 3 to 16 carbon atoms, preferably the glycidyl, glycidyl ether, glycidyl ester or glycidyloxyalkyl radicals; or group X described above; and a and b, which are identical to or different from one another, are 0, 1, 2 or 3, the sum of a and b not exceeding 3.

Such an alkoxysilane compound may be a tetraalkoxysilane, epoxyalkoxysilane or aminoalkoxysilane.

Very good results have been obtained with tetraethoxysilane, 3-glycidyloxypropyltrimethoxysilane, 3-aminopropyltrimethoxysilane and 3-(aminoethylamino) propyltrimethoxysilane as the alkoxysilane compound.

In order to improve further the adhesion between conversion coating and polymer coating, it is advisable additionally to add a compound capable of forming a titanium complex to the solution that is to be applied to the conversion coating. The term "compound capable of forming a titanium complex" denotes compounds which form bridged $TiO_2$—$SiO_2$ systems by complex-type bonding with the alkoxysilane compound and the conversion coating. Furthermore, the reaction between alkoxysilane compound and titanium compound produces a crosslinked polymer coating.

A particularly suitable compound is an alkoxytitanium compound, a titanic ester or a titanium chelate, especially a compound of the formula $Ti(OR)_4$, in which R is a an alkyl radical of 1 to 6 carbon atoms which is preferably selected from the group consisting of methyl, ethyl, n-propyl, i-propyl and butyl radicals.

Very good results have been achieved with tetraethoxytitanate $Ti(OC_2H_5)_4$.

The molar ration between alkoxysilane compound and titanium compound is not critical and is generally between 1 and 20.

Solutions which include both an alkoxysilane compound and a compound capable of forming a titanium complex are described, for example, in DE 41 38 218 A1 and may be purchased from various companies (e.g. Deltacoll® 80 from Dörken).

Where necessary, the polymer coating may also have a colour. In this case, the solution to be polymerized and/or crosslinked additionally comprises at least one dye which is soluble in a polar solvent, in particular a metal complex dye. A metal complex dye of this kind is available, for example, under the commercial designation Neozapon® from BASF, Orasol® from Ciba-Geigy, Savinyl® from Sandoz or Lampronol® from ICI.

Owing to the solubility of the dye in a polar solvent, a homogeneous solution and, accordingly, a homogeneous structure of the polymer coating is achieved. There is therefore no accumulation of the dye in the polymer coating, which might otherwise act as a "built-in" fracture point between conversion coating and polymer coating.

In the process of the invention for producing a conversion coat, the passivation is preferentially conducted within a pH range of the aqueous passivating electrolyte of from 7.0 to 8.0.

Accordingly, it is possible to forego the addition of acids. This means that it is unnecessary to reduce the pH by adding acids in order to increase the oxidizing power of the permanganate anions.

Furthermore, it is possible for the first time with the process of the invention to conduct a sufficient passivation at a temperature of the aqueous passivating electrolyte of from 15 to 50° C., in particular from 20 to 30° C.

The passivation is usually conducted for a period of from 2 to 10 minutes.

The concentration of potassium permanganate in the aqueous passivating electrolyte of the invention is preferably from 1 to 10 g/l; that of the alkali metal or ammonium salt of the vanadate, molybdate and/or tungstate ions is preferably from 1 to 10 g/l. In particular, the upper limit on the vanadate, molybdate and/or tungstate concentration is not critical. Thus the process of the invention can be conducted even with an electrolyte which comprises a saturated solution of these salts, even with undissolved constituents.

The synergistic effect between permanganate ions and vanadate, molybdate and/or tungstate ions becomes particularly clear when it is attempted to passivate an article made of magnesium using only an aqueous potassium permanganate solution with a concentration of from 1 to 10 g/l, with identical operating parameters. This is because, under these conditions, it is not possible to obtain a conversion coating affording an adequate corrosion protection effect.

The articles passivated in accordance with the invention comprise, for example, parts for the motor vehicle industry, electrical and electronics industry, mechanical engineering industry, the aerospace industry, and parts of sports equipment.

Particular mention may be made of parts of engines and transmission casings, instrument panels, doors and individual parts of them, steering gear casings, wheel spiders for motorbikes, throttle valve casings, receptacles for milling cutters, rotors or displacer casings for compressors, sealing jaws for packaging machines, parts for plug strips and electrical connectors, lamp bases, lamp housings, rotor casings of helicopters, housings for electrical equipment, and parts of sporting bows.

Magnesium alloys which may be employed in particular are all customary diecasting, casting and wrought alloys. Examples are, in particular, AZ91, AZ81, AZ61, AM60, AM50, AM20, AS41, AS21, AE42, QE22, ZE41, ZK61 and AZ31, AZ60, ZK30, ZK60, WE43 and WE54 (ASTM codes).

The invention further relates to the use of a solution for producing an article of the invention, this solution comprising at least one of the alkoxysilane compounds described above.

As a pretreatment for the chemical passivation of the invention, the articles made of magnesium or its alloys are pickled beforehand in conventional manner with mineral acids such as phosphoric acid, hydrofluoric acid, nitric acid, etc.

Furthermore, it is possible to apply a paint or other coating material in addition to the conversion coating, with or without an additional polymer coating.

Suitable coating materials are all commercially customary coating materials on a powder or epoxy basis, and electrodeposition coating materials. Preference is given to powder coating materials based on high molecular mass epoxy resins of the bisphenol A type, alone or in combination with a carboxyl-containing polyester resin, as are available, for example, under the designation Delta-S-NT-Pulverlack from Dörken, Herdecke, Germany.

The following examples serve to illustrate the invention.

Comparative Example 1

12 sheets of the magnesium alloy AZ91HP measuring 50×100×2 mm are chromated in accordance with the MIL specification M3171 type I.

Batches of three of the sheets passivated in this way are subjected, in the original condition (without sealing), and sealed with special coatings, to a salt spray test in accordance with DIN 50021-SS.

The sealant used is a silane combination (DELTACOLL 80 from Dörken) and/or an epoxy-polyester powder coating material (Delta-S-NT-Pulverlack from Dörken) in accordance with the conditions specified in Table I.

The results of the salt spray test are reported in Table I.

EXAMPLE 1

12 sheets of the magnesium alloy AZ91HP measuring 50×100×2 mm are pickled in 75% strength $H_3PO_4$ for 30 seconds. They are then rinsed with deionized water and neutralized in 10% strength NaOH at room temperature for 30 seconds; thereafter, the sheets are again rinsed with deionized water. In the wet state, the sheets are immersed in an aqueous passivating electrolyte at room temperature for 5 minutes, the electrolyte consisting of an aqueous solution of 3 g/l $KMnO_4$ and 1 g/l $NH_4VO_3$. Following the removal of the sheets from the passivating bath, the conversion coating, which has a grey-brown appearance, is rinsed with deionized water and then dried at 110° C. for 30 minutes.

Batches of three of the sheets passivated in this way are subjected, in the original condition (without sealing), and sealed with special coatings, to a salt spray test in accordance with DIN 50021-SS.

The sealant used is a silane combination (DELTACOLL 80 from Dörken) and/or an epoxy-polyester powder coating material (Delta-S-NT-Pulverlack from Dörken) in accordance with the conditions specified in Table I.

The results of the salt spray test are reported in Table I.

TABLE I

| | Comparative Example 1 [h]* | Example 1 [h]* |
|---|---|---|
| Passivation without sealing | 5–10 | 5–10 |
| Passivation + silane combination (DELTACOLL 80) | 412–495 | 451–608 |
| Passivation + epoxy polyester coating material (Delta-Pulverlack) 80 to 100 μm | 505–603 | 528–607 |
| Passivation + silane combination (DELTACOLL 80) + epoxy polyester powder coating (Delta-Pulverlack) 80 to 100 μm | 796–1038 | 818–1038 |

*The smaller figure corresponds to the time at which the first of the three sheets shows signs of inadequate corrosion protection; the larger figure indicates the time at which the last of the three sheets shows signs of inadequate corrosion protection.

Comparative Example 2

6 sheets of the magnesium alloy AM50HP measuring 50×100×2 mm are chromated in accordance with the MIL specification M3171 type I.

Batches of three of the sheets passivated in this way are subjected, in the original condition (without sealing), and sealed with a silane combination (DELTACOLL 80 from D örken), to a salt spray test in accordance with DIN 50021-SS.

The results of the salt spray test are reported in Table II.

EXAMPLE 2

6 sheets of the magnesium alloy AM50HP measuring 50×100×2 mm are pickled in 40% strength HF at room temperature for 60 seconds. After rinsing with deionized water, the sheets are immersed in an aqueous passivating electrolyte consisting of an aqueous solution containing 4 g/l $KMnO_4$ and 1.5 g/l $Na_2WO_4$ at room temperature for 10 minutes. Following the removal of the sheets, the conversion coating, which has a golden-brown iridescence, is rinsed with deionized water and dried at 110° C. for 60 minutes.

Batches of three of the sheets passivated in this way are subjected, in the original condition (without sealing), and sealed with a silane combination (DELTACOLL 80 from D örken), to a salt spray test in accordance with DIN 50021-SS.

The results of the salt spray test are reported in Table II.

TABLE II

| | Comparative Example 2 [h]* | Example 2 [h]* |
|---|---|---|
| Passivation without sealing | 5–10 | 5–10 |
| Passivation + silane combination (DELTACOLL 80) | 483–694 | 552–745 |

*The smaller figure corresponds to the time at which the first of the three sheets shows signs of inadequate corrosion protection; the larger figure indicates the time at which the last of the three sheets shows signs of inadequate corrosion protection.

Comparative Example 3

6 sheets of magnesium alloy AZ91HP measuring 50×100×2 mm are chromated in accordance with the MIL specification M3171 type I.

Batches of three of the sheets passivated in this way are sealed with a silane combination (DELTACOLL 80 from D örken) and with an epoxy-polyester powder coating material (Delta-S-NT-Pulverlack from Dörken) and then subjected to a salt spray test in accordance with DIN 50021-SS.

The number of points of corrosion was determined as a function of time. The results are reported in Table III.

EXAMPLE 3

6 sheets of AZ91HP measuring 50×100×2 mm are pickled in 75% strength $H_3PO_4$ for 30 seconds. They are then rinsed with deionized water, neutralized with 10% strength aqueous NaOH for 45 seconds, and then rinsed with deionized water again.

Then, in the wet state, the sheets are immersed in an aqueous passivating electrolyte consisting of an aqueous solution of 3 g/l $KMnO_4$ and 1 g/l $NaVO_3$ at room temperature for 4 minutes. Following the removal of the sheets, the conversion coating, which has a grey-brown appearance, is rinsed with deionized water and then dried at 110° C. for 45 minutes.

Batches of three of the sheets passivated in this way are sealed with a silane combination (DELTACOLL 80 from D örken) and with an epoxy-polyester powder coating material (Delta-S-NT-Pulverlack from Dörken) and then subjected to a salt spray test in accordance with DIN 50021-SS.

The number of points of corrosion was determined as a function of time. The results are reported in Table III.

TABLE III

| | Corrosion points after 100 h | Corrosion points atter 200 h | Corrosion points after 350 h |
|---|---|---|---|
| Example 3 + silane combination (DELTACOLL 80) | 0 | 0 | 1 |
| Comparative Example 3 + silane combination (DELTACOLL 80) | 3 | 4 | 8 |
| Example 3 + epoxy-polyester powder coating material (Delta-Pulverlack) 80 to 100 μm | 0 | 0 | 0 |
| Comparative 3 + epoxy-polyester powder coating material (Delta-Pulverlack) 80 to 100 μm | 0 | 0 | 1 |

Table III clearly shows improved corrosion protection for the conversion coating of the invention when a silane combination is used.

What is claimed is:

1. Article comprising an electroless conversion coating in contact with magnesium or its alloys, wherein the electroless conversion coating comprises MgO, $Mn_2O_3$ and $MnO_2$ plus at least one oxide from the group consisting of vanadium, molybdenum and tungsten.

2. Article with an electroless conversion coating, wherein the electroless conversion coating is prepared by a process comprising contacting the article having a surface consisting essentially of magnesium or an alloy thereof with an aqueous passivating electrolyte which comprises potassium permanganate and at least one alkali metal sit or ammonium salt of an anion from the group consisting of vanadate, molybdate and tungstate in the absence of an applied electric current.

3. Article according to claim 1, further comprising a polymer coating applied to the electroless conversion coating, said polymer coating comprising at least one polymerized or crosslinked alkoxysilane compound.

4. Article according to claim 3, wherein the alkoxysilane compound is of the general formula, $$R^1_aR^2_bSiX_{(4-a-b)}$$

in which

X is an alkoxy, aryloxy or acyloxy group of 1 to 12 carbon atoms; $R^1$ and $R^2$, which are identical to or different from one another, are selected from the group consisting of amino, monoaklylamnio or dialkylamino radicals;

alkyl radicals;

alkynyl radicals;

alkenyl radicals;

aryl radicals;

epoxy radicals; or group X described above; and a and b, which are identical to or different from one another, are 0, 1, 2 or 3, the sum of a and b not exceeding 3.

5. Article according to claim 4, wherein the alkoxysilane compound is selected from a tretraalokoxysilane, epoxy-alkoxysilane or aminoalkoxysilane.

6. Article according to claim 5, characterized in that the alkoxysilane compound is selects from the group consisting of tetraethoxysilane, 3-glycidyloxypropyltrimethoxysilane, 3-aminopropyltrimethoxysilane and 3-(aminoethylamino) propyltrimethoxysilane.

7. Article according to claim 3, wherein the polymer coating further comprises a titanium complex.

8. Article according to claim 7, wherein the titanium complex is a reaction product of an alkoxytitanium compound, a titanic ester or a titanium chelate and in particular is of the formula $Ti(OR)_4$ in which R is an alkyl radical of 1 to 6 carbon atoms.

9. Article according to claim 8, wherein the alkoxytitanium compound is tetraethoxytitanate $Ti(OC_2H_5)_4$.

10. Article according to claim 3, wherein the polymer coating filter comprises at least one dye which is soluble in a polar solvent.

11. Process for coating an article with a magnesium or magnesium alloy surface, comprising subjecting the article to electroless passivation using an aqueous passivating electrolyte which comprises potassium permanganate and at least one alkali metal salt or ammonium salt of an anion from the group consisting of vanadate, molybdate and tungstate in the absence of an applied electric current.

12. Process according to claim 11, characterized in that the passivation is conducted within a pH range of the aqueous passivating electrolyte of from 7.0 to 8.0.

13. Process according to claim 11, characterized in that the passivation is conducted at a temperature of the aqueous passivating electrolyte of from 15 to 50° C.

14. Process according to claim 11, characterized in that the passivation is conducted for a period of from 2 to 10 minutes.

15. Process according to claim 11, characterized in that the concentration of potassium permanganate in the aqueous passivating electrolyte is from 1 to 10 g/l.

16. Process according to claim 11, characterized in that the concentration of the alkali metal salt or ammonium salt from the group consisting of vanadate, molybdate and tungstate in the aqueous passivating electrolyte is from 1 to 10 g/l.

17. Process according to claim 11, further comprising applying a paint or other surface coating material to the electroless conversion coating.

18. Article according to claim 4, wherein the alkoxysilane compound is of the general formula, $$R^1{}_aR^2{}_bSiX_{(4-a-b)}$$

wherein

X is an alkoxy, aryloxy or acyloxy group of 1 to 4 carbon atoms;

$R^1$ and $R^2$, which am identical to or different from one another, are selected from the group consisting of amino, monoalkylamino or dialkylamino radicals, alkyl radicals of 1 to 6 carbon atoms. alkynyl radicals of 2 to 6 carbon atoms, alkenyl radicals of 2 to 6 carbon atoms, aryl radicals of 6 to 10 carbon atoms, and epoxy radicals of 3 to 16 carbon atoms.

19. Article according to claim 18, wherein the alkoxysilane compound is of the general formula $$R^1{}_aR^2{}_bSiX_{(4-a-b)}$$

wherein

X is selected from the group consisting of methoxy, ethoxy, n-propoxy, i-propoxy, butoxy, phenoxy, acetoxy and propionyloxy groups $R^1$ and $R^2$, which are identical to or different from one another, are selected from the group consisting of amino, monoalkylammo or dialkylamino radicals;

alkyl radicals selected from methyl, ethyl, n-propyl, isopropyl, n-butyl, s-butyl, t-butyl, pentyl, hexyl or cyclohexyl radicals;

alkynyl radicals selected from acetylenyl or propargyl radicals;

alkenyl radicals selected from vinyl, 1-propenyl, 2-propenyl or butenyl radicals;

aryl radicals selected from phenyl or naphthyl radicals; and epoxy radicals selected from glycidyl, glycidyl ether, glycidyl ester or glycidyloxyalkyl radicals.

* * * * *